US010463151B2

(12) United States Patent
Murphy

(10) Patent No.: US 10,463,151 B2
(45) Date of Patent: Nov. 5, 2019

(54) ADJUSTABLE FLOATING SHELVING SYSTEMS

(71) Applicant: LOCK & LOAD SHELVING SYSTEMS PTY LTD, Hastings, Victoria (AU)

(72) Inventor: Luke Murphy, Balnarring (AU)

(73) Assignee: LOCK & LOAD SHELVING SYSTEMS PTY LTD, Hastings, Victoria (AU)

( * ) Notice: Subject to any disclaimer, the term of this patent is extended or adjusted under 35 U.S.C. 154(b) by 29 days.

(21) Appl. No.: 14/917,629

(22) PCT Filed: Sep. 8, 2014

(86) PCT No.: PCT/AU2014/050216
§ 371 (c)(1),
(2) Date: Mar. 9, 2016

(87) PCT Pub. No.: WO2015/031960
PCT Pub. Date: Mar. 12, 2015

(65) Prior Publication Data

US 2016/0220023 A1 Aug. 4, 2016

(30) Foreign Application Priority Data

Sep. 9, 2013 (AU) ..... 2013903443

(51) Int. Cl.
*A47B 96/02* (2006.01)
*A47B 47/00* (2006.01)
(Continued)

(52) U.S. Cl.
CPC ..... *A47B 96/028* (2013.01); *A47B 47/00* (2013.01); *A47B 57/34* (2013.01); *A47B 96/066* (2013.01);
(Continued)

(58) Field of Classification Search
CPC ..... A47F 5/08; A47F 5/0846; A47F 5/0853; A47B 96/066; A47B 96/067
(Continued)

(56) References Cited

U.S. PATENT DOCUMENTS 701,000 A * 5/1902 Ahrens ..... A47B 88/43 211/134
3,182,769 A * 5/1965 De Ridder ..... E04C 2/40 108/64
(Continued)

FOREIGN PATENT DOCUMENTS

EP 1082923 A2 3/2001
FR 1451356 A 9/1966
(Continued)

OTHER PUBLICATIONS

International Search Report dated Nov. 19, 2014 for corresponding International Patent PCT/AU2014/050216, filed Sep. 8, 2014.
(Continued)

*Primary Examiner* — Stanton L Krycinski
(74) *Attorney, Agent, or Firm* — David D. Brush; Westman, Champlin & Koehler, P.A.

(57) ABSTRACT

Apparatus for connecting shelving and other hanging components (hanging baskets, boxes, prongs and display holders) to a backing board. The shelves have a pre-fitted protruding aluminium extrusion piece that fits into and locks into a dovetail piece that is pre-installed into a pre-cut triangle groove in the backboard. The backing board has a number of pre-cut grooves (to suit customer requirements) running the length of the board that are filled with the dovetail extrusions. The shelves can be removed without tools, can take significant weight and cannot be accidently dislodged.

17 Claims, 5 Drawing Sheets

(51) Int. Cl.

| | |
|---|---|
| ***A47B 57/34*** | (2006.01) |
| ***A47B 96/06*** | (2006.01) |
| ***A47B 96/14*** | (2006.01) |
| ***A47F 5/08*** | (2006.01) |
| ***A47F 5/10*** | (2006.01) |

(52) U.S. Cl.
CPC ..... *A47B 96/068* (2013.01); *A47B 96/1466* (2013.01); *A47F 5/08* (2013.01); *A47F 5/0853* (2013.01); *A47F 5/10* (2013.01)

(58) Field of Classification Search
USPC ..... 211/94.01, 162
See application file for complete search history.

(56) References Cited

U.S. PATENT DOCUMENTS 3,268,195 A * 8/1966 Hoffman ..... A47G 1/1686 248/220.31
4,509,648 A * 4/1985 Govang ..... A47F 5/0846 211/59.1
4,817,538 A * 4/1989 Michaelsen ..... A47B 57/34 108/108
5,154,304 A * 10/1992 McAuley ..... A47F 5/0846 211/106.01
6,363,645 B1 * 4/2002 Hunter ..... A47F 5/0846 211/87.01
6,631,813 B1 * 10/2003 Walter ..... A47F 5/0846 211/123
D482,552 S * 11/2003 Campbell ..... D25/121
D486,676 S * 2/2004 Campbell ..... D6/702
6,772,890 B2 8/2004 Campbell et al.
7,122,744 B2 * 10/2006 Walter ..... A47B 97/00 174/161 R
8,128,043 B2 * 3/2012 Walter ..... A47B 96/061 248/221.11
8,348,070 B2 1/2013 Hopkins
8,602,227 B1 * 12/2013 McDonald ..... A47F 5/0853 211/193
8,882,065 B2 * 11/2014 Henriott ..... A47B 96/067 160/130
9,004,427 B2 * 4/2015 Irudayaraj ..... A47B 96/061 211/134
9,375,085 B2 * 6/2016 Derelov ..... A47B 88/044
2006/0091093 A1 * 5/2006 Armari ..... A47B 96/067 211/94.01
2008/0224004 A1 * 9/2008 Gallien ..... A47B 96/066 248/220.1
2010/0175332 A1 * 7/2010 Henriott ..... A47B 96/067 52/36.6
2013/0107501 A1 * 5/2013 Ewald ..... A47F 5/0853 362/145
2013/0112637 A1 * 5/2013 Kuhn ..... A47F 5/0853 211/105.1

FOREIGN PATENT DOCUMENTS

FR 2880640 A1 7/2006
GB 2423236 A 8/2006

OTHER PUBLICATIONS

International Preliminary Report on Patentability dated Dec. 15, 2015 for corresponding International Patent PCT/AU2014/050216, filed Sep. 8, 2014.
Examination Report issued by IP Australia for corresponding Australian Patent Application 2014317818, dated Jan. 19, 2016.
Written Opinion of the International Searching Authority dated Nov. 19, 2014, for corresponding International Patent PCT/AU2014/050216, filed Sep. 8, 2014.

* cited by examiner

ADJUSTABLE FLOATING SHELVING SYSTEMS

CROSS-REFERENCE TO RELATED APPLICATION

This Application is a Section 371 National Stage Application of International Application No. PCT/AU2014/050216, filed Sep. 8, 2014, the content of which is incorporated by reference in its entirety, and published as WO 2015/031960 A1 on Mar. 12, 2015, in English.

TECHNICAL FIELD

This invention relates to an easily mounted adjustable shelving system for retail and residential purposes with no visible brackets.

BACKGROUND

A commonly used shelving system for fitting out of retail shops is the slat wall-type system which is very industrial looking, having heavy brackets and limited options with the sizes of backboard and length of shelves.

In one aspect, there is a need in the art for a more elegant and adjustable system that is not industrial looking and would complement the display of a retail shop, business premises or home.

It is an aspect of the present invention to overcome or alleviate a problem of the prior art by providing an improved shelving system, or simply an alternative to prior art shelving systems.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each provisional claim of this application.

SUMMARY OF THE INVENTION

In a first aspect, but not necessarily the broadest aspect, the present invention provides a substantially upright member comprising a channel extending thereinto, the channel angled downwardly into the member, the channel having an upper wall and a lower wall, the upper wall having a recess disposed therein.

In one embodiment of the upright member, the recess is disposed at or toward the blind end of the channel.

In one embodiment of the upright member, the channel walls are fabricated from a material that is resilient to deformation.

In one embodiment of the upright member, the channel walls are fabricated from a metal or a plastic.

In one embodiment of the upright member, the channel is formed separately to the upright member, and is fitted to or incorporated into the upright member.

In one embodiment of the upright member, the edge of the lower wall at the open end of the channel is configured to form a pivot point.

In one embodiment the upright member is a panel, or a board or a wall.

In one embodiment of the upright member, the channel runs substantially horizontally.

In a second aspect, the present invention provides an insert configured to be inserted into a channel in an upright member, the insert comprising a first region, and a second region, the first and second regions being separated by a bend in the insert, the first region having an upper face with an engaging member extending therefrom.

In one embodiment the insert comprises a stop member extending from an upper surface of thereof.

In one embodiment of the insert, the stop member extends from an area about the bend.

In one embodiment of the insert, the stop member extends from the second region, and adjacent to the bend.

In one embodiment of the insert, the second region comprises one or more formations configured to assist in attaching the insert into an attachable item.

In one embodiment of the insert the attachable item is a shelf.

In a third aspect the present invention provides an anchoring system comprising the upright member as described herein, and the insert as described herein wherein the channel of the upright member and the insert are configured such that the region of the insert comprising the engaging member is insertable into the channel, and when inserted into the channel the insert is pivotable on a pivot point of the channel such that the engaging member is moveable into the recess of the channel thereby locking the channel and insert together.

In one embodiment of the anchoring system, the pivot point of the channel is the edge of the lower wall of the channel at the open end of the channel.

In one embodiment of the anchoring system, the insert pivots in response to a downward force applied at or about the terminus of the insert distal to the upright member.

In a fourth aspect, the present invention provides a method for providing an upright member capable of receiving an insert, the method comprising the steps of: providing an upright member, and modifying the member to comprise a channel extending thereinto, the channel angled downwardly into the member, the channel having an upper wall and a lower wall, the upper wall having a recess disposed therein.

In one embodiment of the method, the step of modifying comprises fitting a receiving means comprising a channel extending thereinto, the channel angled downwardly into the member, the channel having an upper wall and a lower wall, the upper wall having a recess disposed therein.

In a fifth aspect the present invention provides a receiving means operable in the method of modifying an upright member as described herein, the receiving means comprising a channel having an upper wall and a lower wall, the upper wall having a recess disposed therein.

In a fifth aspect, the present invention provides a method for inserting an insert into an upright member, the method comprising the steps of: providing the upright member as described herein, and inserting the insert of any one of claims 9 to 12 into the channel of the upright member.

DETAILED DESCRIPTION OF THE INVENTION AND PREFERRED EMBODIMENTS

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

Figure 1A:
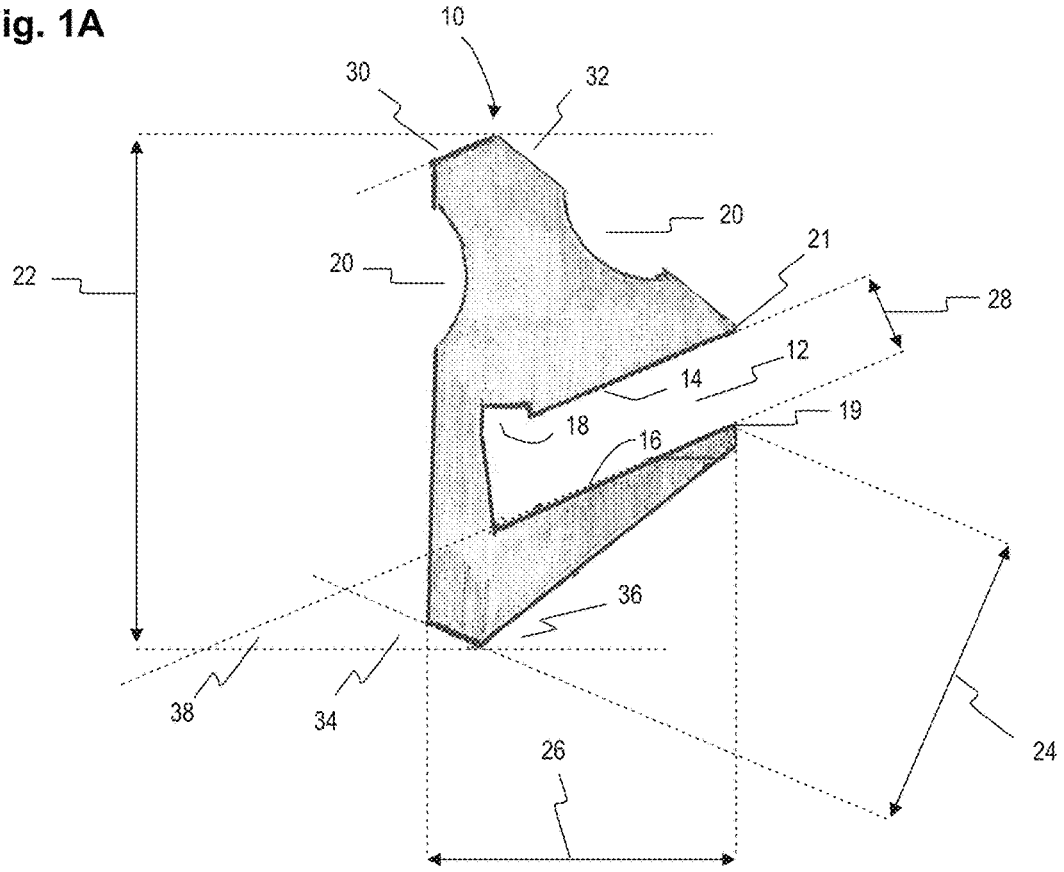
FIG. 1A is a cross-sectional diagram of a preferred receiving means of the present invention. The receiving means may be inserted into an upright member, such as a wall, to provide an anchorage point for an insert of the present invention.

Turning to FIG. 1A there is shown a receiving means 10 of the present invention, that may be inserted into an upright member (such as a panel or a wall) to provide an anchorage point for an insert. The receiving means has a channel 12 having an upper wall 14 and a lower wall 16. At the blind end of the channel 12 is a recess 18.

The receiving means 20 provides a pivot point 19 at the edge of the lower face 16 of the channel 12. The function of the pivot point 19 is to allow for a slight rocking of an insert inserted into the channel 12 (more of which is discussed infra).

The receiving means 20 provides an abutment point 21 at the edge of the upper face 14 of the channel 12. The function is the abutment point 21 is to engage with an insert inserted into the channel 12 to prevent the inserted being pushed an excessive distance into the channel 12 (more of which is discussed infra).

The receiving means is shown in the orientation in which it is typically used, such that the channel 12 runs downwardly with reference to a horizontal floor upon which the upright member is standing.

Figure 1B:
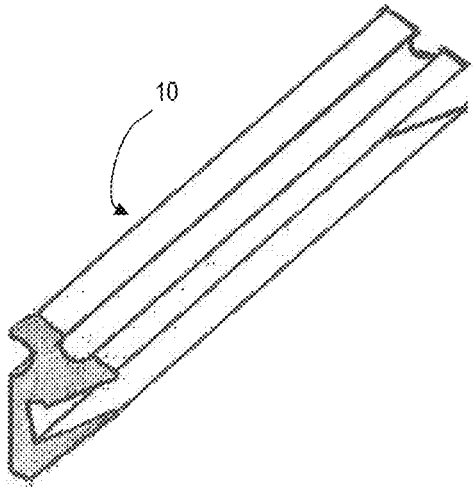
FIG. 1B is a perspective view of the receiving means of FIG. 1A.

The perspective view of FIG. 1B shows the elongate configuration of the receiving means. Thus, the channel 12 runs horizontally, but extends downwardly and into the upright member when fitted. As will be appreciated the receiving means is not required to extend the entire width of the upright member. For example, only two relatively short receiving means may be inserted into opposing edges of the upright member so as to provide two anchorage points.

The preferred embodiment of FIG. 1 is formed from aluminium, and includes cut out sections 20 to reduce material usage.

Exemplary dimensions and angles (including preferred ranges of angles) are as follows:

22 21.5 mm±10 mm
24 12.7 mm±5 mm
26 12.5 mm±5 mm
28 3.8 mm±0.5 mm
30 25±10 degrees
32 40±20 degrees
34 25±10 degrees
36 40±20 degrees
38 24±24 degrees With regard to these exemplary dimensions and angles, the cited range with respect to any dimension or angle is not to be construed to mean strict adherence to the upper or lower dimension or angle is required. Moreover, these exemplary dimensions and angles (with cited ranges) are useful in application of the receiving means to a board of about 18 mm thickness. It will be appreciated that a board of different thickness may be used, in which dimensions and/or angles recited supra may be modified by routine means.

Figure 2:
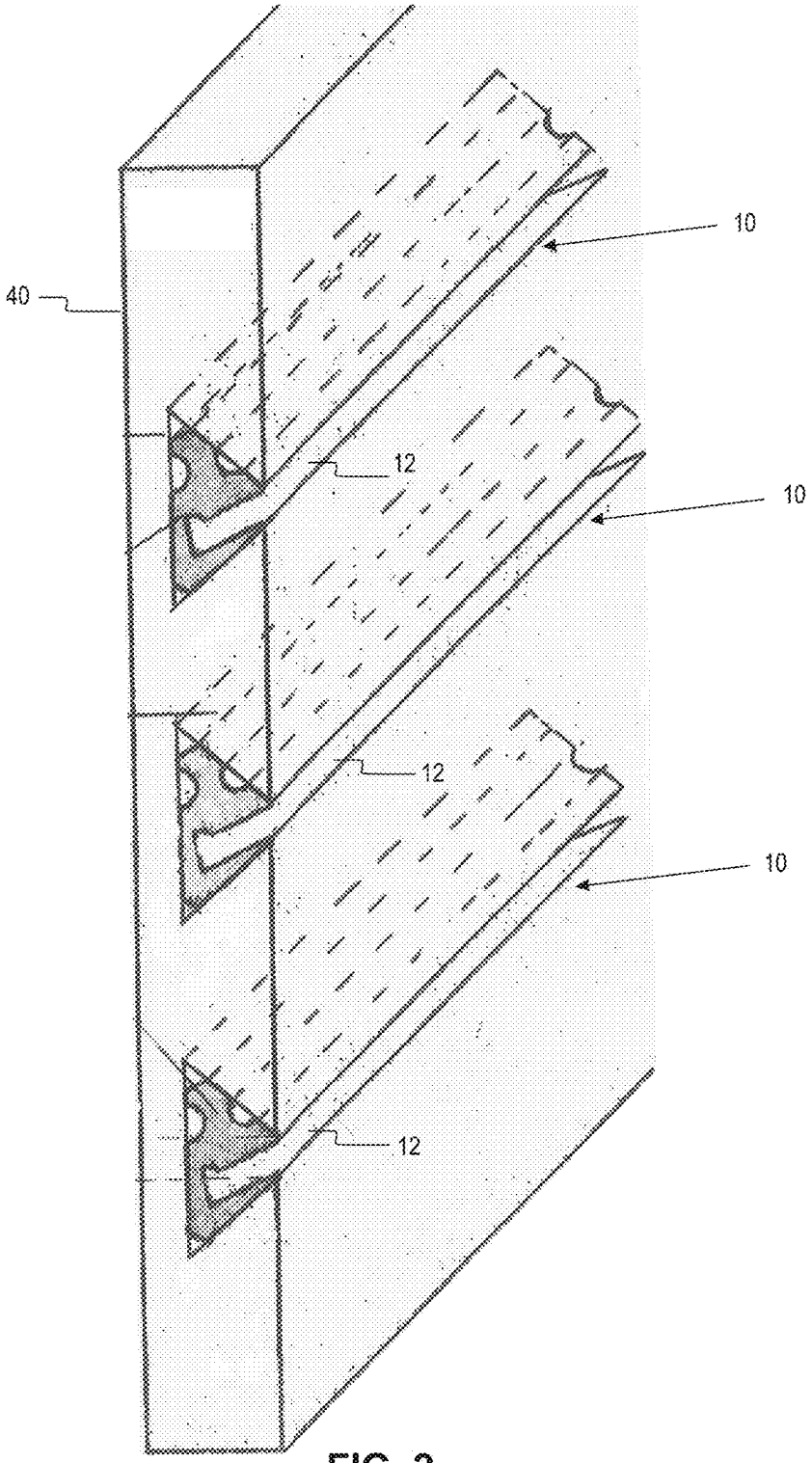
FIG. 2 is a perspective diagram of several receiving means as shown in FIG. 1A. The receiving means has been inserted longitudinally into a generally triangular bore hole present in a wall.

FIG. 2 shows an upright member 40 (being a backboard of 18 mm depth in this embodiment) having several receiving means 10 inserted thereinto. A specialised routing tool was used to create the space for accepting the receiving means 10. The space is substantially triangular in cross-section, although flattened at the apex. The flattened apex section of the routed space provides the opening for the channel 12 to present to the outside.

It will be understood that embodiments of the invention directed to a discrete receiving means that is inserted into any existing upright member are preferred only. Other receiving means may be attached to an outer surface of the upright member, or indeed formed integrally with the upright member.

Figure 3:
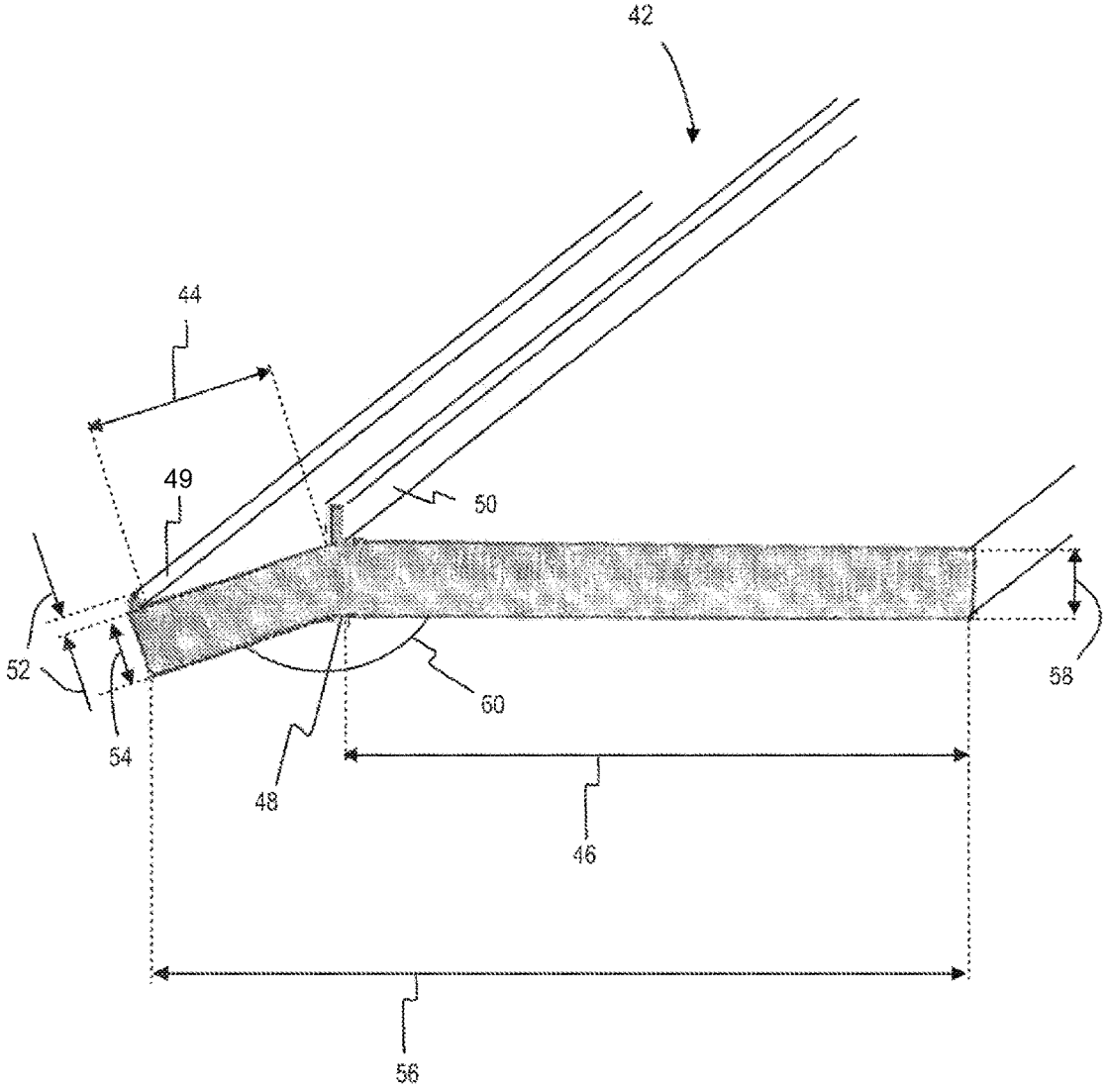
FIG. 3 is a cross-sectional diagram of a preferred insert of the present invention. The insert is configured to insert into the receiving means shown in FIGS. 1A, 1B and 2.

Turning to FIG. 3 there is shown an insert 42 configured to be inserted into the channel 12 presented at the vertical face of the upright member. The insert is fabricated from aluminium, and comprises a first region 44 and a second region 46, the two regions demarcated by a bend 48. The first region 44 comprises an engaging member 49 on the upper face.

The insert 42 is shown in the drawing is in the orientation in which it is intended to be used. In this orientation, the first region 44 extends downwardly into the channel presented by the receiving means, and the second region 46 extends substantially horizontally from the vertical face of the upright member. The horizontal extension of the second region 46 allows for the hanging of an item such as a shelf, a box, a basket or a rod from the upright member. The item may be configured so as to substantially envelope the second region 46 to provide for the maximum surface area of contact between the item and the second region 46. An adhesive may be used at the interface between the item and the second region 46.

The preferred insert further comprises a stop member 50 extending from the upper surface of the insert 42 at the bend 48. The purpose of the stop member 50 is to prevent the insert 42 being forced an excessive distance into the channel 12 presented at the face of the upright member. This is achieved by the collision of the stop member 50 with the abutment point 21 upon insertion of the insert. By virtue of the positioning of the stop member 50, the insert 42 is properly located such that the acute angle of the bend 48 sits on the pivot point 19 of the channel 12 thereby allowing for minor rocking of the insert 42.

The minor rocking allows for the engaging member 49 of the insert to move into the recess 18 of the channel 12 thereby locking the two components together. Thus, upon application of a downward load placed on the second region 46 of the insert 42 (for example, by placing an item on a shelf attached to the insert 42) the second region is displaced downwardly. This causes pivoting of the insert 42 at the bend 48, thereby causing the terminus of the first region to be displaced upwardly thereby moving the engaging member 49 into the recess 18.

It will be appreciated that the greater the load placed on the second region 46, results in a greater upward force being applied to the engaging member 49 against the recess 18 to further increase the resistance against the insert 42 being pulled out of the channel 12.

It will be appreciated that the engaging member 49 not be at the terminus of the insert 42, and may be located at any point on the upper face of the first region 44 of the insert 42. However, a greater upward force will be applied to the engaging member if it is disposed at the terminus this providing for more secure retention of the insert.

Similarly, while the second region 46 may be any length greater leverage is provided where that region is longer, resulting in a greater upward force being applied to the engaging member 49.

Figure 4A:
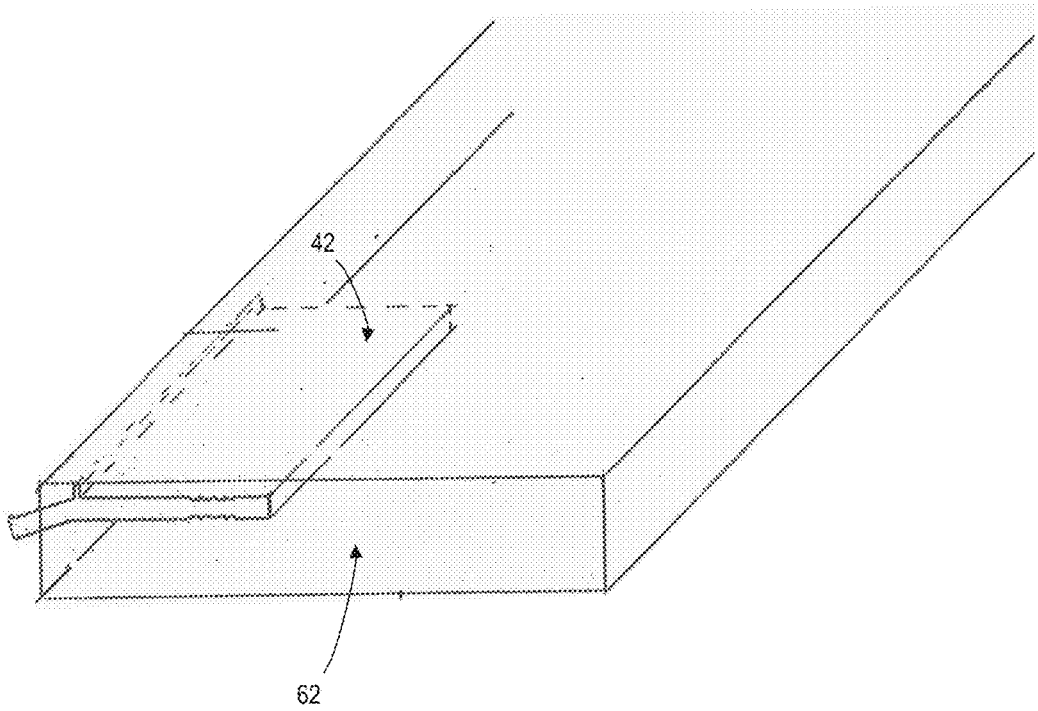
FIG. 4A is a perspective diagram of an insert of the present invention attached to a shelf. The insert is shown more clearly at FIG. 4B.
Figure 4B:
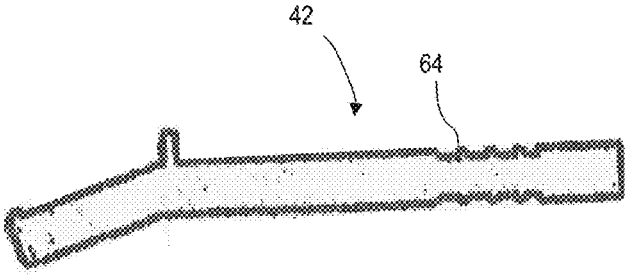
FIG. 4B is a cross-sectional diagram of a preferred insert of the present invention, having formations which assist in engaging the insert to an item, such as a shelf.

Exemplary dimensions and angles for the insert 42 are shown below:

44 10.2±5 mm
46 30±5 mm
52 0.36±0.05 mm
54 3.25±0.25 mm
56 41.54±0.4 mm
58 3.5±0.5 mm
60 162 degrees±18 degrees With regard to these exemplary dimensions and angles, the cited range with respect to any dimension or angle is not to be construed to mean strict adherence to the upper or lower dimension or angle is required. These exemplary dimensions and angles (with cited ranges) are useful for an insert which is matched to a receiving means configured for use with a board of about 18 mm thickness, having the dimensions and angles as recited supra. It will be appreciated that a board of different thickness may be used, in which dimensions and/or angles recited supra in respect of the insert may be modified FIGS. 4A and 4B shows a modified form of the insert 42, having formations 64 in the second region. The function of the formations is to increase the engagement of the insert 42 with an attached item such as a shelf 62.

Figure 5A:
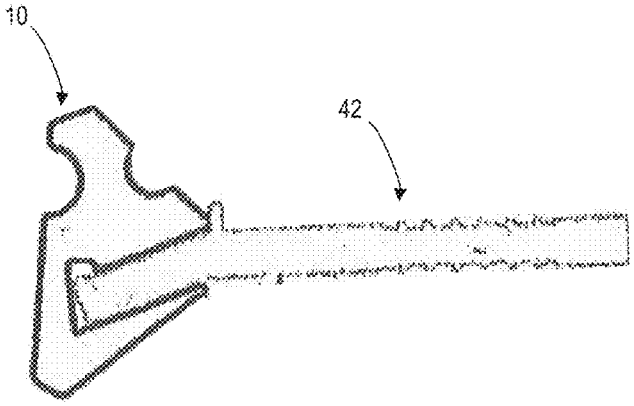
FIG. 5A is a cross-sectional diagram showing the insert of FIG. 4B inserted into the receiving means of FIG. 1.
Figure 5B:
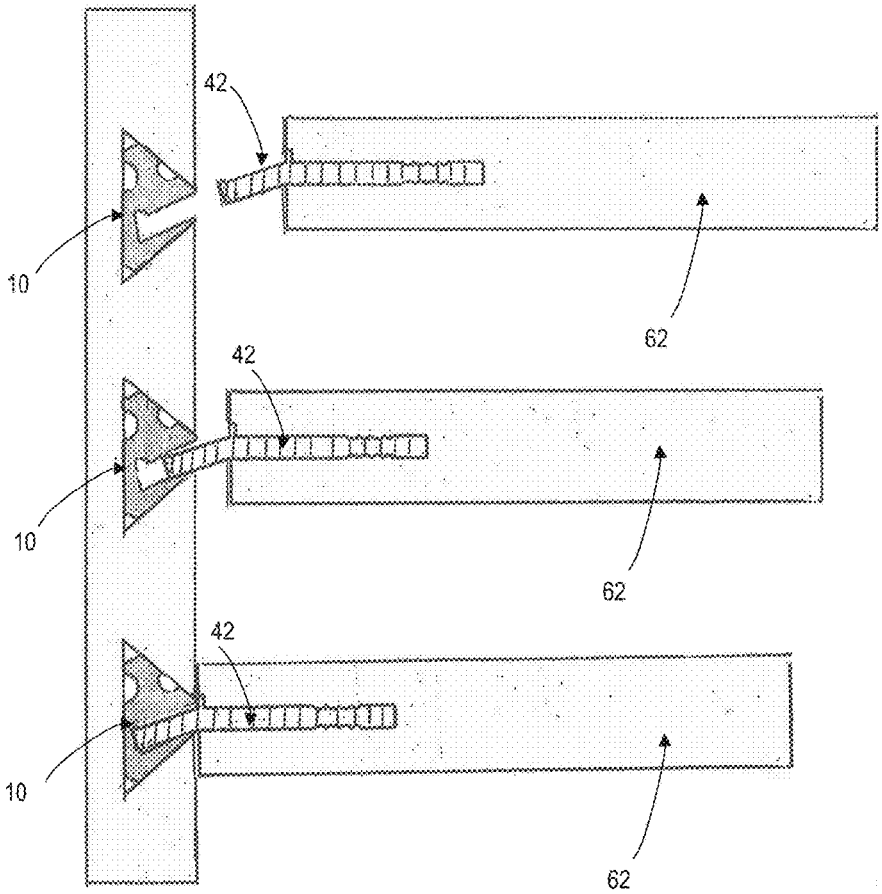
FIG. 5B is a cross-sectional diagram showing the receiving means of FIG. 1 in combination with the insert of FIG. 4B in the context of a shelving system extending from a panel.

FIGS. 5A and 5B show a preferred anchoring system used to secure a series of shelves to a backboard. The three shelves in FIG. 5B shows sequentially the method by which a shelf is attached. It will be note that the shelf (with the first region of the insert extending from a lateral face) is firstly brought toward the backboard, and the first region inserted into the channel. The shelf is then urged toward the backboard until the stop member on the insert collides with abutment point of the retaining means. At the point the weight of the shelf exerts a downward force on the second region of insert, therefore forcing the engaging member of the first region of the insert into the recess in the upper channel wall.

It will be understood that the actual materials, dimensions and angles of the receiving or the insert means may be alterable according to the practical application of the invention. For example, where the invention relates to a shelving system designed to carry significant weight materials of greater strength may be used, or overall dimensions of the receiving means may be increased as required. Such alteration is will within the ability of the skilled artisan using only routine means.

It will be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

Further disclosure of preferred embodiments is provided below.

The applicant set about coming up with such a design that would satisfy the requirements of the customer. A number of years of trial and error including manual bending of steel inserts to come up with a basic design resulted in further testing by way of 3d printer prototypes of 5 mm size of the dovetail and insert. This finally progressed to the first dies being made by the aluminium company to provide the applicant with full size dovetails and inserts to be able to finally test the concept with actual production of full size boards and shelves. The concept required very specific tooling to enable the appropriate cuttings in the backboard and the shelf, these tools were designed and form part of the specific production process.

Summary: 'Lock and Load Adjustable Floating Shelving Systems is an innovative, fully adjustable shelving display system that has no visible brackets giving the end product an impression of a floating shelf system. It is designed to be mounted on an existing wall. The system can utilise a range of construction materials including timber, (thickness 18 mm-32 mm), veneer board, melamine colour board (laminex), glass and stainless steel laminate. The feature backing board can also be manufactured in multiple colours and materials as per the customer's requirements. The "Adjustable Floating shelving system" significantly enhances shelving manufacturing productivity—reducing production time, cost, wastage and installation time as well as providing unique shelving flexibility and features for the customer. The system incorporates a dovetail extrusion fitted into pre-cut grooves on a backboard. An insert extrusion piece is then fitted into the edge of a shelf and this shelf is then simply placed into the dovetail that is within the backboard. The particular shape of the dovetail allows the insert to lock into place. No further brackets are required. The system is not limited to shelves—hooks, boxes, baskets and other pieces can be attached to the backing board by way of connection to the dovetail.

The Adjustable Floating shelving system is significantly different from existing shelving systems. The major differences are:

No visible brackets, no butt joints. The 'bracket' (locking piece) is inbuilt into the shelf. Similarly, a backing board insert (dovetail) is separately inbuilt into the backing board. Thus once the backing board has been secured in place, the shelving only requires pushing into place in the dovetail extrusion to allow for 'locking' into place. No extra fittings or tooling is required.

Utilises a 3.6 mm groove to provide the 'floating shelf' feature. Greater length and height capacity of the backing board—3.6 meters in length by 1.8 meters in height relative to the closest competition on the market to date that offers 1.2 meters in length and 2.4 meters in height OH & S compliance—Stability of shelving produced is significantly enhanced—the locking and load position of the shelving prohibits easy dislodgement. It cannot be accidentally knocked loose, it requires a combined lift and pull process to release it from the backing board.

Load capacity equal to or greater than current competition. Shelves will take up to 20-30 kg depending on length and depth of shelf. Aesthetically pleasing to the eye as there are no visible brackets—unlike most adjustable shelving systems that are currently on the market. Fully customisable to suit customer requirements.

Flat pack (DIY) options for residential use—easily mounted by the average person—no cabinetry skills required. Adaptable to use new environmentally friendly and sustainable products such as bamboo sheeting. Minimal waste products (sawdust and off-cuts).

Feature backing board is fully adaptable in shape and size to suit customer requirements. Allows for additional hanging products such as prongs, baskets etc Specific tooling is required in order to produce the locking piece and backing board insert.

The Figures show a Side view and Dimensions of Dovetail retaining means: The dovetail retaining means which is inserted into a pre-cut triangle cut-out in the backboard.

This triangle has an angle ranging from 20 to 60 Degrees, depending on the circumstances of the client needs The dovetail retaining means extrusion has been reshaped around the external boundary to allow for reduction in weight and therefore cost of production, however its intention is to fill the pre-cut triangle groove in the backboard.

The opening of the dovetail is 3.6-4 mm plus or minus 2.0 mm. The rear internal angle of the opening is 74.8 degrees. Angle ranges from 0 to 45 degrees. Current standard model is 24 degrees. Length of this section 12.7 mm. Overall depth is 12.50 mm plus or minus 5.0 mm. Angle is 25 degrees plus or minus 10 degrees. Overall height is 21.5 mm plus or minus 5.0 mm The figures show 3D Dovetail retaining means and side view Backboard: MDF Backboard—standard dimensions 18 mm thick, may vary up to 32 mm thick. Height and width vary depending on customer requirements—up to 1800 mm high, 3600 mm long. Backboard edge revealing pre-cut triangle grooves, cut with tooling piece as shown in FIG. 5.2. Grooves are a minimum of 70 mm apart, on a 1.2 m high board, we expect up to 7 grooves cut into backboard, running the whole length of the backboard. Each groove pre-cut will be filled with dovetail retaining means extrusion to allow for any number of shelves or combination of lengths of shelves per backboard.

The figures show Dovetail retaining means extrusion inserted into grooves. 3D view of dovetail retaining means extrusion, length according to length of backboard. Opening cut of triangle in Backboard is 6 mm plus or minus 3 mm.

The insert locking piece that is fitted into a shelf. The depth gauge/guide (stop member) is set to ensure the piece fits correctly into the shelf and the dovetail, it also provides for consistency of production to minimize variations in the product. This guide also allows for greater tool life of the tooling piece as it can be sharpened multiple times without unduly affecting the insert.

The length of the insert is variable to suit the particular product that will be connected to the backing board. At present for a standard shelf of 1200 mm the insert length is 300 mm plus or minus 100 mm, it is expected two lengths of approximately 300mm will be inserted into this size shelf. Therefore the inserts will cover from 40% to 60% of the length of the shelf, depending on the use of the shelf. An 800 mm shelf will have two 200 mm inserts etc. Height of insert to be 3.5 mm, plus 5 mm or minus 1.5 mm.

The remainder of the shape (tail) will change to suit the appropriate piece that will be connected to the backing board—i.e. a hanging rod or basket. Current width is 30 mm, but may range from 15 mm to 300 mm depending on whether it is inserted into a shelf or it becomes a shelf itself. The overall width is currently 41.54 mm but dependant on width of tail as set out above.

The angle from tail to head is 162 degrees, plus or minus 18 degrees. The head of the locking piece will remain consistent in shape so as to "lock" into the dovetail retaining means, width of the head is currently 10.20 mm but may change dependant on size and angle of dovetail changes as specified herein.

Insert and Shelf. Some figures show actual size of insert—side view. 3D view of standard shelf, height from 16 mm to 60 mm, Depth 50 mm to 300 mm. Length up to 2400 mm. Tail of insert now fixed into shelf, with head protruding from shelf so it can be fitted into dovetail retaining means. Pre-cut groove in shelf cut by tooling.

Angle of insert to dovetail is 92 degrees, plus or minus 2 degrees.

The figures show Side view of Backboard with three dovetails inserted—(shaded) allowing for three shelves to be connected to backboard. Side view of shelf with tail of insert fixed into it, head protruding, ready to be pushed into the dovetail and locked into place by unique design of dovetail and insert combination. Side view of shelf with insert, partly pushed into dovetail. Side view of shelf fully pushed into dovetail and butting up at right angle to backboard.

An innovative method to connect shelving and other hanging components to a backing board without the need to permanently fix by screws or have large and unsightly brackets gives the impression of floating shelves as the interlocking pieces are hidden within the back board and the shelf. The shelves have a pre fitted protruding aluminium extrusion piece that simply fits into and locks into a dovetail piece that is pre-installed into a cut out triangle groove in the backboard.

The backing board has a number of pre-cut grooves (to suit customer requirements) running the length of the board that are filled with the dovetail extrusions, thereby allowing a range of different placements at various locations on the backing board.

The shelves can be removed without tools and placed into any other pre-cut groove in the backboard. The particular shape of the dovetail and the insert allow for an interlocking system that takes significant weight and cannot be accidently dislodged. The dovetail and insert design does not limit itself to shelves, it allows for numerous other hanging items such as hanging baskets, boxes, prongs and Perspex display holders.

Features of some embodiments of the invention are as follows:

1. No visible brackets after shelf is connected to backboard. The shelf has a slot cut that holds the tail of the fitted extrusion, the projecting head connects to a dovetail that is fixed within the backing board.
2. The backing board has pre-cut grooves running the length of the board that are filled with the dovetail extrusion.
3. Once shelf connected to backboard, it hides the pre-cut groove.
4. Results in an adjustable floating shelf system with no visible brackets.
5. Opening of the pre-cut grooves in the backing board are 3.5-8 mm.
6. Feature backing board is fully adaptable in shape, size and number of pre-cut grooves to suit customer requirements.
7. Shelf length can be up to 2.4M long
8. Shelf load capacity is up to 20 KG per 1.2 meter shelf.
9. Shelf is easily removed without undoing brackets—uses a lift and angle method to release shelf from backing board.
10. Shelf can be removed from one groove and replaced into any pre-cut groove in the backing sheet without any tooling requirements.
11. Backing board can be customised to any number of pre-cut grooves depending on customer requirements, with a minimum gap between grooves of 70 mm.
12. System not limited to shelves, can hang various shapes and sizes of retail fittings from the backboard such as boxes, baskets and prongs.
13. OH& S improvements for commercial use—reduction in accidental dislodgment of shelf or other hanging item. Reduction in loss of stock damage, reduction in employee injury or customer injury from accidental dislodgment.
14. Reduction in installation time as no requirement of the end user to fit any brackets, only requirement is fixing of backing board to a wall.

The invention claimed is:

1. An insert for supporting a weight of up to 20 kg, the insert configured to be inserted into a channel in an upright member, the insert comprising:

a first region being rigid and substantially linear, having an upper face, a lower face and an engaging member being rigid and extending from the upper face for a distance that is less than the thickness of the first region; and a second region being rigid and substantially linear, having an upper face and a lower face, the first and second regions being separated by a bend in the insert, the bend forming a concave corner at an intersection of the lower face of the first region and the lower face of the second region so as to form an obtuse angle.

2. The insert of claim 1 comprising a stop member extending from an upper surface thereof.

3. The insert of claim 2 wherein the stop member extends from an area about the bend.

4. The insert of claim 3 wherein the stop member extends from the second region, and adjacent to the bend.

5. The insert of claim 1 wherein the second region comprises one or more formations configured to assist in attaching the insert into an attachable item.

6. The insert of claim 5 wherein the attachable item is a shelf, or a box, or a basket, or a prong, or a display holder.

7. An anchoring system comprising:

a substantially upright member comprising a groove into which an extrusion is fitted, the extrusion having a channel extending thereinto, the channel angled downwardly with reference to the upright member, the channel having an upper wall and a lower wall, the upper wall having a recess disposed therein; and an insert configured to be inserted into the channel in the extrusion, the insert comprising:

a first region being rigid and substantially linear, having an upper face, a lower face and an engaging member being rigid and extending from the upper face for a distance that is less than the thickness of the first region; and a second region having an upper face and a lower face, the first and second regions being separated by a bend in the insert, the bend forming a concave corner at an intersection of the lower face of the first region and the lower face of the second region, so as to form an obtuse angle, wherein the channel of the extrusion and the insert are configured such that the first region of the insert comprising the engaging member is insertable into the channel, and when inserted into the channel the insert is pivotable on a pivot point of the channel that engages the concave corner such that the engaging member is moveable into the recess of the channel thereby locking the channel and the insert together.

8. The anchoring system of claim 7 wherein the pivot point of the channel is formed at an edge of the lower wall of the channel at an open end of the channel.

9. The anchoring system of claim 7 wherein the recess is disposed at or toward a blind end of the channel.

10. The anchoring system of claim 7 wherein the upper and lower walls of the channel are fabricated from a material that is resilient to deformation.

11. The anchoring system of claim 7 wherein the upper and lower walls of the channel are fabricated from a metal or a plastic.

12. The anchoring system of claim 7 wherein the channel is formed separately to the upright member, and is fitted to or incorporated into the upright member.

13. The anchoring system of claim 7 wherein the channel comprises an open end, and the lower wall comprises an edge, and wherein the edge of the lower wall at the open end of the channel forms the pivot point.

14. The anchoring system of claim 7 wherein the upright member is a panel, or a board or a wall.

15. The anchoring system of claim 7 wherein the channel runs substantially horizontally.

16. The anchoring system of claim 7 wherein the upright member has a dovetail groove formed therein, and a dovetail extrusion snugly fitted into the dovetail groove, the channel being formed in the dovetail extrusion.

17. The insert of claim 1 wherein the second region of the insert forms a shelf.

* * * * *